United States Patent [19]

Kuo

[11] Patent Number: 4,907,011

[45] Date of Patent: Mar. 6, 1990

[54] FORESHORTENED DIPOLE ANTENNA WITH TRIANGULAR RADIATING ELEMENTS AND TAPERED COAXIAL FEEDLINE

[75] Inventor: Samuel C. Kuo, Saratoga, Calif.

[73] Assignee: GTE Government Systems Corporation, Mountain View, Calif.

[21] Appl. No.: 133,581

[22] Filed: Dec. 14, 1987

[51] Int. Cl.[4] ..... H01Q 11/10

[52] U.S. Cl. ..... 343/792.5; 343/802; 343/807

[58] Field of Search ..... 343/792.5, 793, 794, 343/795, 802, 810

[56] References Cited

U.S. PATENT DOCUMENTS

| | | | |
|---|---|---|---|
| 2,981,951 | 4/1961 | Wickersham et al. | 343/792.5 |
| 3,123,827 | 3/1964 | Arnold et al. | 343/792.5 |
| 3,134,979 | 5/1964 | Bell | 343/792.5 |
| 3,543,277 | 11/1970 | Pullara | 343/792.5 |
| 3,732,572 | 5/1973 | Kuo | 343/802 |
| 4,673,948 | 6/1987 | Kuo | 343/807 |
| 4,754,287 | 6/1988 | Kuo | 343/802 |

OTHER PUBLICATIONS

Kuo; "Size Reduce Log Periodic Dipole Array"; 1970, G-AP International Symposium; pp. 151-158; 1970.

Kuo; "Size Reduce Log Periodic Dipole Array Antenna"; Microwave Journal (GB); vol. 15, No. 12, pp. 27-33, 1972.

*Primary Examiner*—Rolf Hille

*Assistant Examiner*—Hoanganh Le

*Attorney, Agent, or Firm*—John A. Odozynski

[57] ABSTRACT

A foreshortened log-periodic antenna which includes variously configured dipole elements and a tapered feedline is disclosed. The dipole elements are arranged in four regions. A first region, located nearest to a feed end of the antenna, includes solid triangular dipoles having constant base-to-height ratios. A second region, adjacent to the first region, includes solid triangular dipoles having decreasing base-to-height ratios. A third region, located adjacent to the second region, includes a single linear dipole. A fourth region, located adjacent to the third region and nearest to a low frequency end of the antenna, includes foreshortened dipoles. The feedline may be implemented either in coaxial or microstrip form so that a lower characteristic impedance is pressed at the feed end of the antenna than at the low frequency end of the antenna. Specifically, for a coaxial feedline having individual conductors separated by a distance "d" at the feed end of the antenna, the individual conductors taper relative to each other so that they are separated by a distance of 2d-5d at the low frequency end of the antenna.

15 Claims, 4 Drawing Sheets

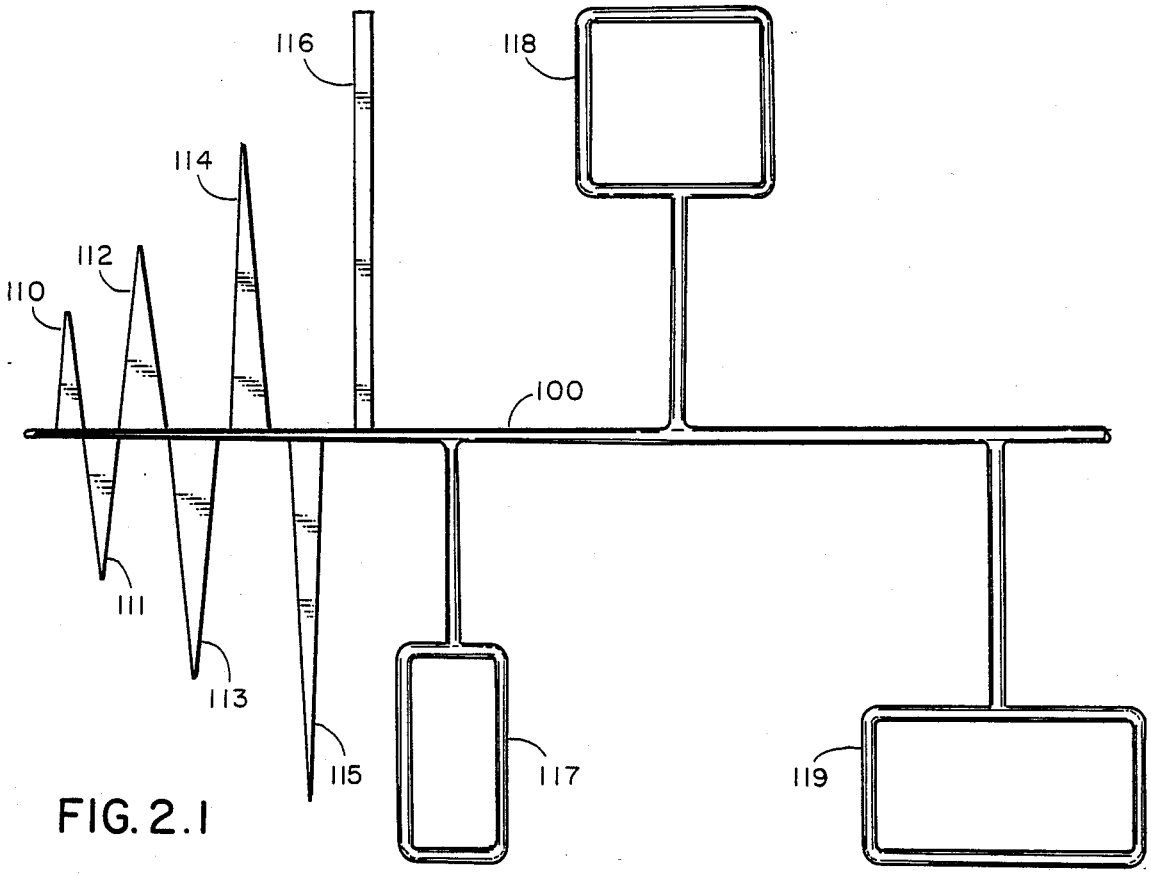
FIG. 2.1
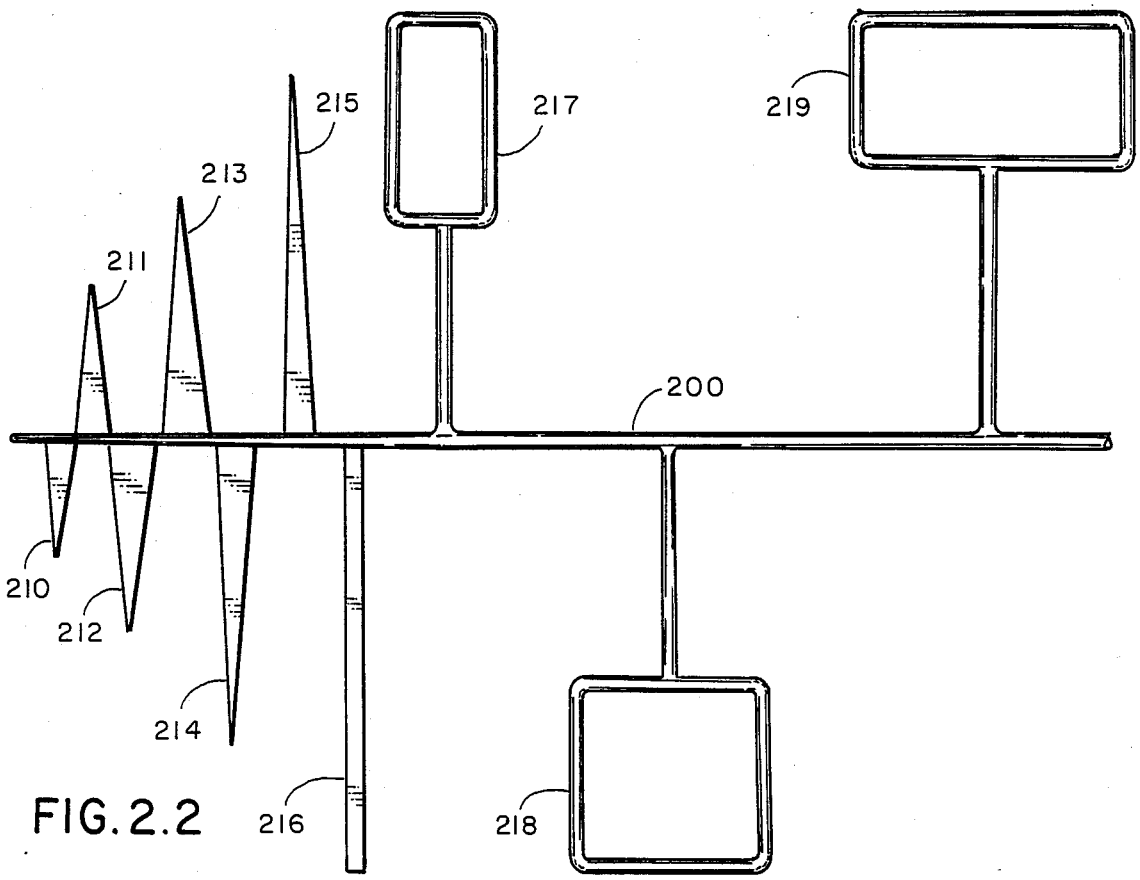
FIG. 2.2

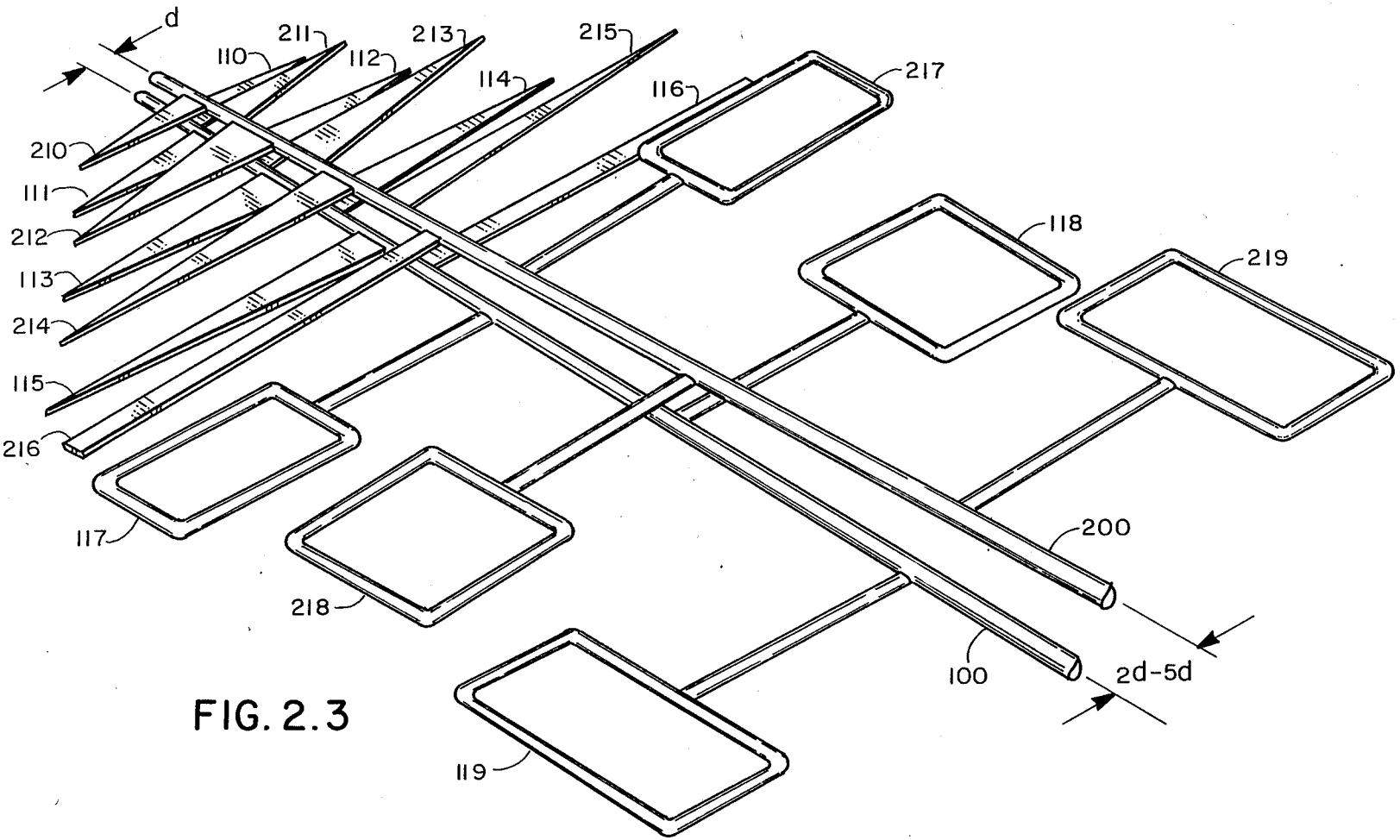
FIG. 2.3

FORESHORTENED DIPOLE ANTENNA WITH TRIANGULAR RADIATING ELEMENTS AND TAPERED COAXIAL FEEDLINE

FIELD OF THE INVENTION

This invention relates to log-periodic dipole antennas and, more particularly, to a foreshortened log-periodic dipole antenna comprising triangular dipoles, a linear dipole, and foreshortened dipole elements coupled to a tapered coaxial feedline.

BACKGROUND OF THE INVENTION

Because the log-periodic dipole antenna ("LPDA") affords a theoretical infinite bandwidth, LPDAs are invariably proposed when broadband antenna performance is demanded. In practice, the frequency range within which an LPDA is able to operate is limited by the detail of the feed point and the length of the largest dipole, respectively. For a conventional LPDA, the length of the largest dipole is on the order of one half the wavelength of the lowest operating frequency. This physical requirement precludes the use of LPDAs in some circumstances.

The conventional LPDA is defined primarily by two design parameters: Alpha, the enclosed angle, and Tau, the ratio of the distance between adjacent dipoles. Alpha controls the length of the antenna structure, and Tau determines the number of dipole elements. LPDAs with Alpha narrower than 15° and Tau greater than 0.9 generally provide high gain and directivity as well as nearly frequency-independent performance. In addition, for each Alpha there exists a correlatively optimal value of Tau. Deviation from the optimal value tends to result in a degradation in antenna performance. In practice, antenna designs seek to minimize Tau because reduced dipole spacing requires less material and results in shorter assembly time. However, with Alpha less than 15°, the LPDA will tolerate a relatively large range of Tau without significant performance degradation. For this reason, most size-reduction experiments have been conducted using LPDAs with relatively small Alpha.

A number of design techniques for LPDAs with small Alphas have been demonstrated. An example is the reduced-size antenna described in U.S. Pat. No. 3,543,277 to Pullara, entitled "Reduced Size Broadband Antenna." An antenna disclosed therein is characterized by an Alpha of 12° and a Tau of 0.95.

Various other efforts have been directed to the reduction of the size of the LPDAs. (See, for example, Stephenson, "Log-Periodic Helical Dipole Array," *WESCON Digest* (1963); E. Young, "Foreshortened Log-Periodic Dipole Array," *WESCON Digest* (1963); Defonzo, "Reduced Size Log-Periodic Antennas," *Microwave Journal* (December, 1972)). Many resulting techniques were directed to capacitive "T" or "U" loading, or to replacing the linear dipoles with helical dipoles. However, such techniques have been able to achieve a reduction in the width of the LPDAs only at the expense of increased antenna boomlength. This is due to the fact that these types of dipoles exhibit higher Q than conventional dipoles. Consequently, an additional number of "foreshortened dipoles" need be added to the LPDA structure in order to preserve the LPDA's frequency-independent, or broadband, characteristics. In addition, these techniques tend to increase the design complexity of the LPDA, primarily because foreshortening requires more than the straightforward replacement of linear dipoles of an existing LPDA with reconfigured, foreshortened dipoles. As a result, the design of the foreshortened LPDA has historically involved a large number of "cut and try" processes.

An improved technique subsequently discovered by the inventor of the instant invention and disclosed in U.S. Pat. No. 3,732,572 (hereinafter "'572") allows simple replacement, on a one-to-one basis, of the linear dipoles of a conventional LPDA with foreshortened counterparts. For further explication, see Kuo, "Size-Reduced Log-Periodic Dipole Array Antenna," *Microwave Journal* (December, 1972). This technique circumvents the experimental approach to foreshortened LPDA design. (The information contained in the '572 patent and the technical article authored by the inventor of the as provided in Section 608.01(p) of the Manual of Patent Examining Procedure.)

The theoretical principle supporting the invention disclosed in '572 derives from the electromagnetic analogy that may be drawn between the rectangular waveguide and the slot antenna. As is well known, the cutoff wavelength of the fundamental mode of a rectangular waveguide is twice the width of the waveguide. Furthermore, the cutoff frequency of a ridged waveguide is known to be lower than that of a rectangular waveguide of identical width and height. Because the resonant frequency of a slot antenna is the analog of the waveguide resonant frequency, the antenna resonant frequency may be expected to correspond to the waveguide cutoff frequency. Specifically, the resonant frequency of a slot antenna may be expected to be reduced when its interior profile is formed in the fashion of the cross section of a ridged waveguide. Finally, because a dipole antenna is an analog, as defined by Babinets' principle, of the slot antenna, it is expected that the physical length of the dipole is susceptible of foreshortening when formed in the shape of a ridged waveguide. Empirical investigation has justified the above hypotheses. To wit: The invention embodied in '572 has permitted the physical size of a conventional dipole antenna to be foreshortened by as much as 35 to 40 percent, without significant effect on the antenna's electrical characteristics. Foreshortening is accomplished by imparting to the dipole the interior cross-sectional profile of a ridged rectangular waveguide. However, even with access to the above technique, foreshortening of antennas with Alphas in excess of 45° is difficult to obtain. Heretofore, no practitioner is known to have successfully reduced the width of LPDAs with Alpha greater than or equal to 45° at frequency higher than VHF range, 300 MHz.

The difficulty in foreshortening LPDAs with Alphas about 45° lies with the conventional LPDA itself. As a result, LPDAs with Alpha greater than 45° simply are not commercially available for microwave frequency range. To date, there has been only limited investigation of the performances and anomalies of LPDAs with large Alpha. (See, for example, Bantin, C. and Balmain, K. "Study of Compressed Log-Period Dipole Antennas," *IEEE Transaction on Antennas and Propagation* (March 1970)). The incentive to develop an LPDA with large Alpha becomes apparent when it is understood that the boomlength of an LPDA with an Alpha of 45° is approximately one fifth the boomlength of an LPDA with Alpha of 12°. Thus, while numerous efforts have been undertaken to reduce the width of the LPDAs with relatively small Alpha, very little effort has been devoted to the investigation of "short" LPDAs. In fact, conventional LPDAs with large Alpha fail to retain their frequency independence unless special techniques are brought to bear.

When the Alpha of an LPDA is increased, the optimized value of Tau is normally reduced in order to maintain proper spacing between the adjacent dipoles. By doing so, the number of near-resonant dipoles is reduced in proportion to the reduction in Tau. When the number of near-resonant dipoles in the active region is insufficient to radiate a substantial portion of the excitation currents, the residue currents will propagate and excite the 1.5L or, perhaps, the 2.5L dipoles. Radiation from these larger dipoles results in deterioration of the frequency-independent characteristics of the LPDAs.

One method which will prevent the larger dipoles from radiating is to increase the feedline characteristic impedance by increasing the spacing of the two-wire balanced feedline. This approach forces a greater proportion of the energy from the feedline into the near-resonant dipoles and therefore reduces the magnitude of the residue currents. As a result, the LPDA typically assumes a mean input impedance of 140 ohms or greater. A broadband impedance transformer is then required to transform the input impedance to 50 ohms. This is very difficult to accomplish at microwave frequencies, especially when the maximum operating frequency approaches 20 GHz.

Another method involves the replacement of the linear dipoles with radiators with lower Q. The triangularly shaped dipole is such a radiator. Its Q decreases as the base of the triangularly shaped dipole increases. Of course, when the base dimension approaches zero, a linear dipole is obtained. These lower Q radiators will couple an enhanced proportion of energy from the feedline, with an effect identical to that obtained by introducing additional radiators into the active region. LDPAs with Alpha equal to 45° have been built and tested, and no anomalies were observed. These results indicate that the largest proportion of the excitation currents are radiated by the near 0.5L dipoles.

A disadvantage of the triangularly shaped dipole is that it resonates at frequencies greater than the resonant frequency of a linear dipole of the same length. For a triangularly shaped dipole that has a height-to-base ratio of 5:1, wherein "height" is defined as one-half of the dipole length, the triangular dipole must be approximately 20% longer than a linear dipole that resonants at the same frequency. Thus, an LPDA which has such triangularly shaped dipoles must be 20% wider and longer than an LPDA with linear dipoles operating over the same frequency range. Clearly this is to be avoided, inasmuch as the salient purpose of the triangularly shaped dipole is to reduce the size of the antenna structure.

Consequently, what is desired is a heretofore unavailable LPDA configuration for antennas with Alpha approaching 45°. The desired LPDA configuration should be amendable to "foreshortening" techniques such as that disclosed in '572. An optimal configuration will circumvent the deterioration in broadband performance attendant heretofore known techniques. Preferably the chosen technique will eliminate the need for a broadband impedance transformer such as is invoked by approaches involving increased spacing of the balanced feedline. Specifically, to the extent triangular radiating elements are employed, it will be necessary to devise an approach that mitigates the additional length that the triangular radiator must assume in order to resonate at the same frequencies as the linear dipole equivalent.

The subject invention is implemented, in one form, by an antenna comprising a coaxial feedline that includes a first coaxial portion and a second coaxial portion, the antenna elements being disposed, in a predetermined fashion, along the lengths of the respective coaxial portions. The first and the second coaxial portions are juxtapositioned so as to exhibit an axial separation that increases in a direction along the length of the coaxial portions. The characteristic impedance of the feedline concomitantly increases along that direction. Antenna elements are disposed along the feedline so that elements of relatively low Q are disposed at positions of relatively low characteristic impedance. Conversely, elements of relatively higher Q are disposed at positions of relatively higher characteristic impedance. More specifically, the antenna consists of two complementary sections with elements disposed in alternately opposite directions from the first and the second coaxial portions.

DISCLOSURE OF THE INVENTION

The above and other objects, advantages and capabilities are achieved in one aspect of the invention by an LPDA which is constrained to a maximum width, W. The antenna comprises a first group of triangular dipoles having monotonically varying heights but substantially mutually equivalent base-to-height ratios. The antenna further comprises a linear dipole having a length substantially equal to W. Interposed between the first group of triangular dipoles and the linear dipole is a second group of triangular dipoles characterized by respective base-to-height ratios that decrease in the direction from the first group of triangular dipoles to the linear dipole. In an optional embodiment, the LPDA includes a group of foreshortened dipoles, each comprising stem portions and generally rectangularly perimetered body portions configured so that the total length of each of the foreshortened dipoles is approximately equal to W.

BRIEF DESCRIPTION OF THE DRAWING

FIGS. 2.1, 2.2, and 2.3 are a representation of a foreshortened dipole antenna with a tapered coaxial feedline.

DESCRIPTION OF A PREFERRED EMBODIMENT

For a better understanding of the subject invention, reference is made to the following description and appended claims in conjunction with the above-described drawings.

Figure 1:
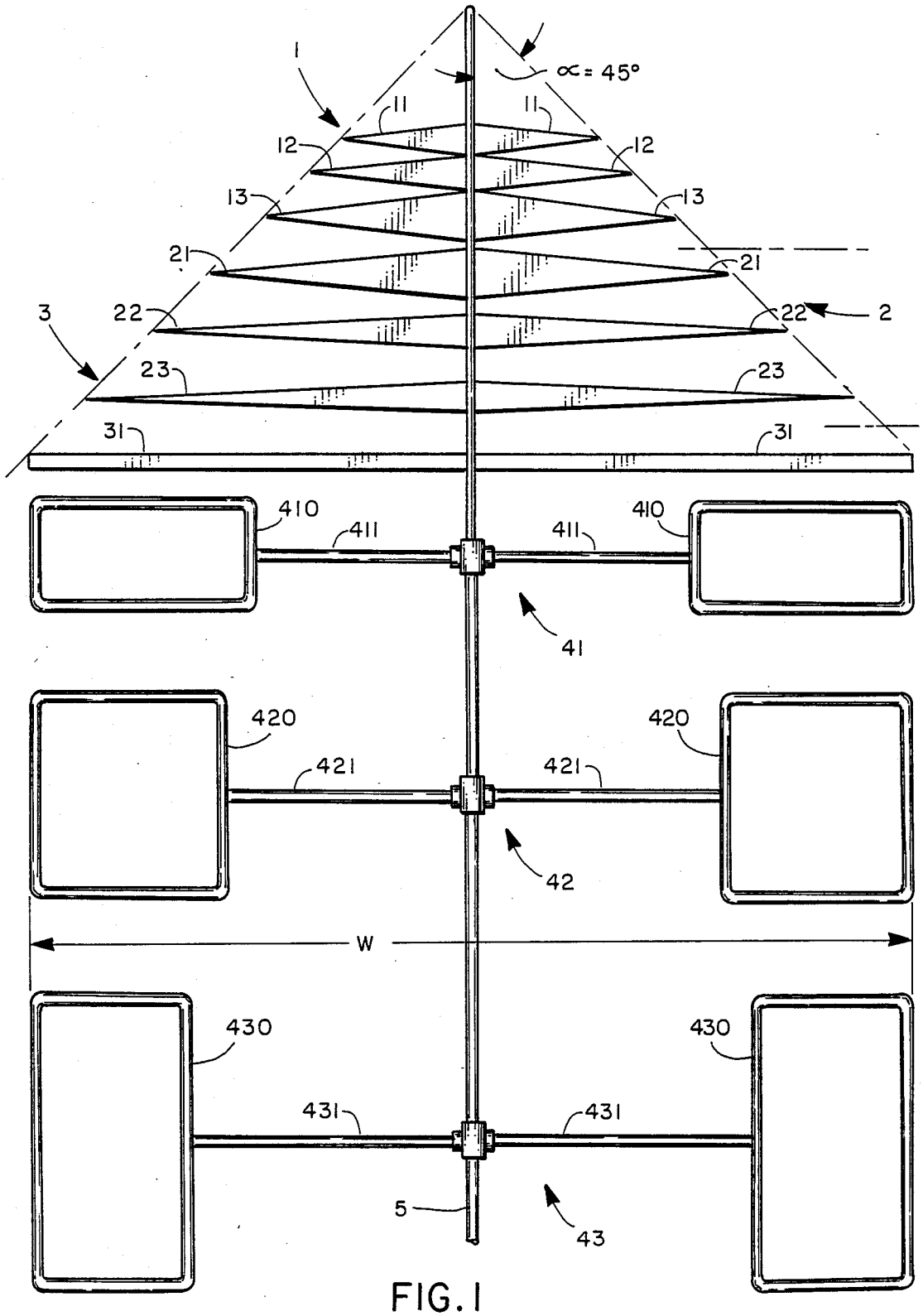
FIG. 1 is a schematic plan view of a log periodic antenna with triangular radiators.

Referring now to FIG. 1, depicted therein is a novel LPDA that comprises an arrangement of triangular dipoles, a single linear dipole, and, optionally as required, a series of foreshortened dipoles such as those disclosed in '572. The antenna may be viewed as being divided into four regions. Region 1 includes a group of solid triangular dipoles 11, 12, 13, of monotonically increasing height. Although dipoles 11, 12, and 13, because of their triangular configuration, necessarily have a physical length greater than the length required of their linear dipole equivalents, they present no compromise in the antenna construction inasmuch as their maximum length lies comfortably within the maximum allowable width, W, of the antenna. Dipoles 11, 12, and 13 are characterized by substantially mutually equivalent base-to-height ratios of 0.2.

Region 2 is a transition region that also includes a group of solid triangular dipoles, 21, 22, and 23, monotonically increasing height. However, in contradistinction to the triangular dipoles of region 1, the dipoles of region 2 exhibit a gradually decreasing base dimension and, therefore, a gradually decreasing base-to-height ratio. For example, for an LPDA operating in the 500 MHz to 20 GHz frequency range, the respective base-to-height ratios of dipoles 21, 22, and 23 assume the respective values of 0.16, 0.12, and 0.08. The dipoles of region 2 offer a smooth transition from the triangular radiators of region 1 to the single linear dipole 31 of region 3. The salient advantages offered by dipoles 21, 22, 23 derive from the fact that these dipoles are relatively low Q radiators and effect the requisite transformation from the high Q dipoles of region 1 into the single linear dipole. Because the dipoles of region 2 have roughly the same height as the linear dipole equivalents, the transformation from region 1 to the linear dipole of region 3 is brought about within the physical constraints imposed on the design of the antenna. Dipole 31 has a total length roughly equivalent to the maximum allowable width of the antenna.

An optional region 4 includes a group of foreshortened, or size-reduced, dipoles, 41, 42 and 43, having the configuration pellucidly set forth in '572. Each of the foreshortened dipoles includes a rectangularly perimetered body portion (410, 420, or 430) attached to feedline 5 through respective stems (411, 421, or 431).

Through utilization of the antenna design techniques disclosed herein, it has been possible to construct an LPDA, constrained to a maximum dimension of 6"×6", that provides frequency-independent performance within the aforementioned range of 500 MHz to 20 GHz. It is clear that, given the above description, an antenna designer possessing merely the skill of a routineer would be able to apply the subject invention to other frequency ranges as directed. Such application is clearly within the scope of this invention as contemplated by the appended claims.

Figure 3:
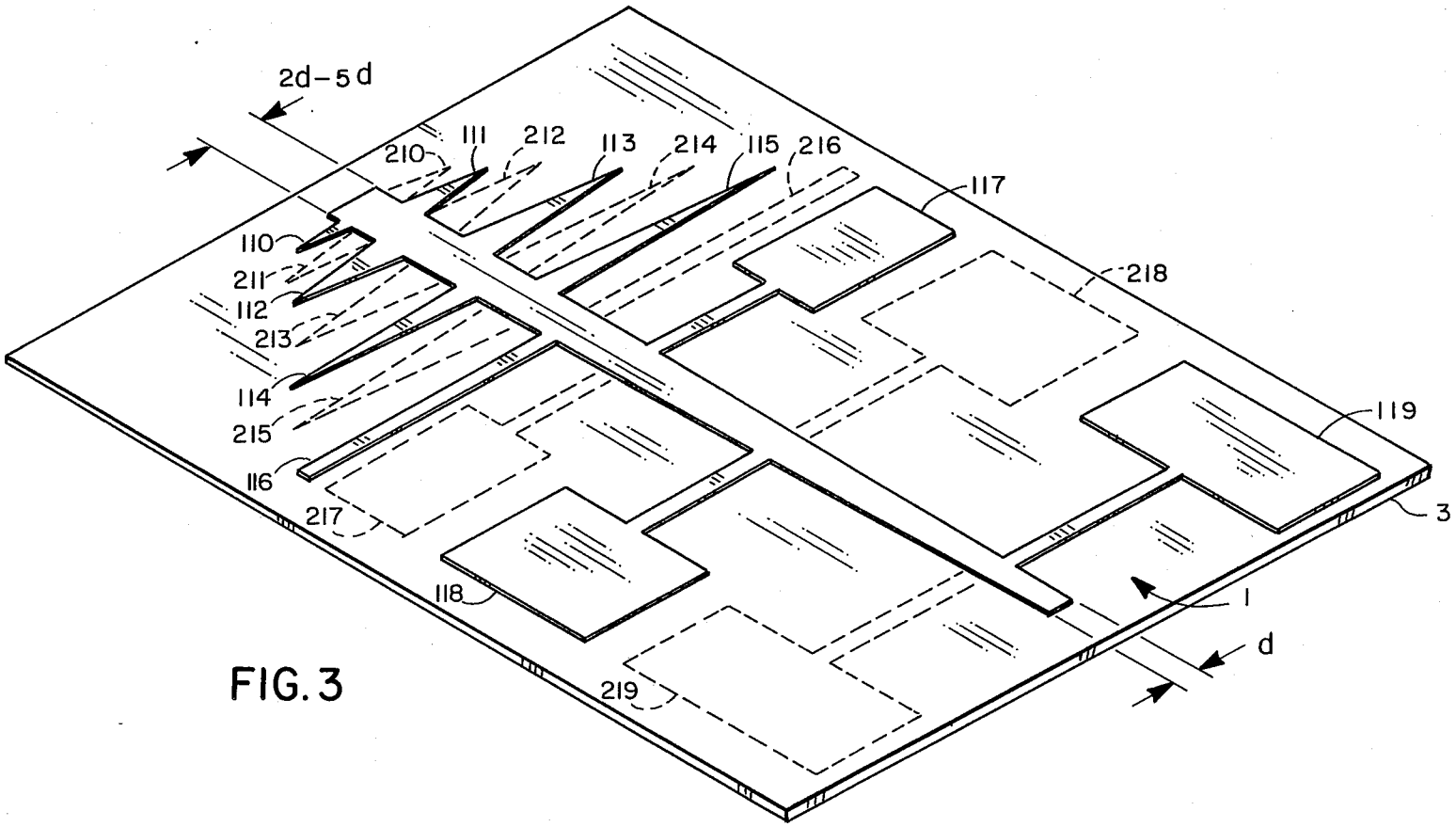
FIG. 3 is a representation of a foreshortened dipole antenna with a tapered microstrip feedline.

In alternative embodiments, performance at the lower operating frequencies can be improved by varying the characteristic impedance of the feedline. Two distinct approaches to this technique are depicted in FIG. 2 and FIG. 3, respectively. FIG. 2 depicts a foreshortened dipole antenna constructed with a coaxial feedline. FIG. 3, on the other hand, depicts a foreshortened dipole antenna, with an analogous element structure, implemented in microstrip.

When coaxial cables are used as the feedline, the characteristic impedance can be tailored by varying the axial spacing of the feedline along the length of antenna structure. As shown in FIG. 2.3, which presents a perspective view of the antenna using a coaxial feedline, the axial spacing between coaxial portions 100 and 200 of the feedline varies from a distance "d" at the end nearest region 1 to a distance between 2d and 5d and the end nearest region 4.

The coaxial configuration can be seen to consist essentially of two complementary sections. The bottom section, depicted in FIG. 2.1, includes a first, substantially linear, coaxial portion 100, along which are disposed a plurality of dipole elements, 110 through 119. The top section, depicted in FIG. 2.2, includes a second, substantially linear, coaxial portion 200, along which are disposed a plurality of dipole elements, 210 through 219. Coaxial portions 100 and 200 constitute the antenna's coaxial feedline.

As can be seen in FIG. 2.3, coaxial portions 100 and 200 are juxtapositioned so as to exhibit an axial separation, along the length of portions 100 and 200, that increases in the direction from elements (110, 210) to elements (119, 219 . The characteristic impedance of the feedline concomitantly increases along that direction. In practice, the axial separation between coaxial portions 100 and 200 varies between a distance "d" nearest elements (110, 210) and a distance between two and five times "d" nearest elements (119, 219).

As can be seen in FIGS. 2.1, 2.2 and 2.3, the top and bottom section of the antenna are complementary in the sense that their respective collinear dipole elements, (110, 210), (111, 211), . . . , (118, 218), and (119, 219), are alternately disposed on opposite sides of the respective coaxial portions 100 and 200. That is to say, with respect to the first collinear dipole pair, 110 and 210, element 110 extends upwardly from coaxial portion 100, whereas element 210 extends downwardly from element 200. Conversely, with respect to the second collinear dipole pair, 111 and 211, element 111 extends downwardly from coaxial portion 100, whereas element 210 extends upwardly from coaxial portion 200. This pair-by-pair alternating relationship continues to reverse itself with respect to each of the succeeding dipole element pairs.

It should be born in mind that, as with the foreshortened dipole described in '572, the antenna depicted in FIG. 2.3 includes four distinct regions. The first region, consisting of elements 110, 210, 111, 211, 112 and 212, comprises a series of solid triangular dipoles characterized by substantially constant base-to-height ratios. The second region, consisting of elements 113, 213, 114, 214, 115 and 215, comprises a series of solid triangular dipoles characterized by decreasing base-to-height ratios. The third region, consisting of elements 116 and 216, comprises one linear dipole. The fourth region, consisting of elements 117, 217, 118, 218, 119, and 219, comprises a series of foreshortened dipoles.

Finally, again as with the foreshortened dipole described in '572, the elements are disposed along the length of coaxial portions 100 and 200 in order of increasing Q. That is, elements (110, 210) exhibit lower Q than elements (111, 211); (111, 211) exhibit lower Q than (112, 212); and so on.

For the case where the LPDA is etched on a printed circuit board and a microstrip transmission line is used as the feedline, the width of the microstrip feedline may be tapered in order t0 vary the characteristic impedance of the feedline. In this case, illustrated in FIG. 3, the feedline width varies from a value in the range of 2d to 5d at the end nearest region 1 to a value of d at the end nearest region 4.

In either the coaxial or the microstrip configuration, the characteristic impedance of the feedline assumes a relatively low value at the feed point in order to provide a better match to 50 ohms. The dipole elements near the feed point are low-Q, triangular dipoles, with relatively large base-to-height ratios. These elements will extract a substantial amount of excitation current from low-impedance feedlines and therefore will circumvent the introduction heretofore encountered anomalies. The invention causes the characteristic impedance of the feed line to be increased toward the large end of the antenna structure where the linear dipole and the foreshortened dipoles, as well as some triangular These relatively high-Q dipole elements will also perform well as a result of their coupling to higher impedance feedlines. It should be noted that a broadband impedance transformer is not required for this configuration because the feedline itself becomes an impedance transformer. This is in contradistinction to feedlines which maintain a uniformly high characteristic impedance throughout the entire length of the feedline and therefore require a broadband impedance transformer at the feed point.

It should be noted that the anomalous performance of LPDAs either results from radiation by the 1.5-wavelength dipoles or arises when the active region (the location along the feedline where radiation takes place) is one-half wavelength from the truncation of the large end. LPDAs with low-Q triangular dipoles are free from these anomalies. In the proposed configuration, with the LPDA Alpha near 45°, the largest dipole is never as much as three times the length of any higher-Q dipole on the same structure. Therefore, no 1.5-wavelength dipoles will ever be excited. Because the antenna is short with respect to the wavelength of the operating frequency, the active region of the higher-Q dipoles is always less than one-half wavelength from the large truncation. For this reason, the proposed antenna will continue to provide satisfactory performance without resort to the alternate embodiment described, provided that the large truncation is terminated into a resistor.

Accordingly, although there has been described herein what at present is deemed to be a preferred embodiment of an LPDA, it will be obvious to those having ordinary skill in the art that various changes and modifications may be made therein without departure from the scope of the invention as defined by the appended claims.

I claim:

1. A foreshortened log-periodic antenna comprising:

(A) a plurality of dipole elements arranged in four regions along the length of a coaxial feedline so as to include:

(a) a first region comprising a series of solid triangular dipoles characterized by substantially constant base-to-height ratios;

(b) a second region comprising a series of solid triangular dipoles characterized by decreasing base-to-height ratios;

(c) a third region comprising at least one linear dipole; and (d) a fourth region comprising a series of foreshortened dipoles, said foreshortened log-periodic antenna further comprising:

(B) a coaxial feedline including a first coaxial portion and a second coaxial portion along which the dipole elements are disposed, wherein the first and second portions are juxtapositioned so as to exhibit an axial separation that increases in the direction away from the first region so that the characteristic impedance of the feedline concomitantly increases along that direction.

2. A foreshortened log-periodic antenna as defined in claim 1, wherein the axial separation between the first and second coaxial portions varies, in total, by a factor of approximately two to five. comprising:

3. A foreshortened log-periodic antenna a first region comprising a series of solid triangular dipole elements characterized by a substantially constant base-to-height ratio;

a second, transition, region comprising a series of triangular dipole elements characterized by a gradually decreasing base-to-height ratio;

a third region comprising at least one linear dipole element; and a coaxial feedline including a first coaxial portion and a second coaxial portion along which the second coaxial portions are juxtapositioned so as to dipole elements are positioned, wherein the first and exhibit an axial separation that increases in the direction away from the first region so that the characteristic impedance of the feedline concomitantly increases along that direction.

4. A foreshortened log-periodic antenna as defined in claim 3, wherein the axial separation between the first and the second coaxial portions varies, in total, by a factor of approximately two to five.

5. A log-periodic dipole antenna comprising:

a coaxial feedline that includes a first, substantially linear, coaxial portion and includes a second, substantially linear, coaxial portion, said first and said second coaxial portions juxtapositioned so that the portions are separated by a distance "d" at a first end of the feedline and are separated by a distance greater than "d" at a second end of the feedline, with the result that the feedline presents a characteristic impedance that increases along the length of the feedline in the direction from the first end of the feedline toward the second end of the feedline; and a first plurality of dipoles disposed at the first end of the feedline, said first plurality of dipoles of solid triangular construction and characterized by substantially constant base-to-height ratios;

a second plurality of dipoles disposed between the first plurality of dipoles and the second end of the feedline, said second plurality of dipoles of solid triangular construction and characterized by decreasing base-to-height ratios; and a linear dipole disposed between the second plurality of dipoles and the second end.

6. A log-periodic dipole antenna as defined in claim 5, wherein the first and the second coaxial portions are separated at the second end by a distance between two and five times the distance "d".

7. A log-periodic dipole antenna as defined in claim 5, further comprising a third plurality of dipoles disposed between the linear dipole and the second end.

8. A log-periodic dipole antenna as defined in claim 7, wherein the first and the second coaxial portions are separated at the second end by a distance between two and five times the distance "d".

9. A log-periodic dipole antenna as defined in claim 8, wherein the third plurality of dipoles are foreshortened dipoles.

10. A log-periodic antenna comprising two complementary sections, a bottom section and a top section, wherein the top section includes a top coaxial portion (200) along which are disposed a plurality of top dipole elements (210), (211), (212), (213), (214), (215), (216), (217), (218), and (219) and wherein the bottom section includes a bottom coaxial portion (100) along which are disposed a plurality of bottom dipole elements (110), (111), (112), (113), (114), (115), (116), (117), (118), and (119), said top coaxial portion and said bottom coaxial portion juxtapositioned so as to exhibit an axial separation that increases along the lengths of coaxial portions (110) and (200) in the direction extending from elements (110) and (210) to elements (119) and (219) so that the characteristic impedance of a feedline formed by coaxial portions (100) and (200) increases along the length of the antenna in the above-defined direction and wherein said elements (110) through (119) and (210) through (219) are disposed along the lengths of coaxial portions (100) and (200) so as to form; (1) a first region consisting of elements (110), (210), (11), (211), (112) and (212), said elements (110), (210), (110), (211), (112), and (212) together forming a series of solid triangular dipoles characterized by substantially constant base-to-height ratios, (2) a second region, consisting of elements (113), (213), (114), (214), (115) and (215), said elements (113), (213), (114), (214), (115), and (215) together forming a series of solid triangular dipoles characterized by decreasing base-to-height ratios, (3) a third region, consisting of elements (116) and (216), which together form a linear dipole, and (4) a fourth region, consisting of elements (117), (217), (118), (218), (119), (and 219), said elements (117), (217), (118), (218), (119) and (219) together forming a series of foreshortened dipoles.

11. A log-periodic dipole antenna was defined in claim 10, wherein the bottom section includes a triangular dipole element (110) extending in a first direction from the bottom coaxial portion (100), a triangular dipole element (111) extending in a second direction from the bottom coaxial portion (110), a triangular dipole element (112) extending in the first direction from bottom coaxial portion (100), a triangular dipole element (113) extending in the second direction from the bottom coaxial portion (100), a triangular dipole element (114) extending in the first direction from the bottom coaxial portion (110), a triangular dipole (115) extending in the second direction from bottom coaxial portion (110), a linear dipole element (116) extending in the first direction from the bottom coaxial portion (100), a foreshortened dipole element (117) extending in the second direction from the bottom coaxial portion (100), a foreshortened dipole element (118) extending in the first direction from the bottom coaxial portion (100), and a foreshortened dipole element (119) extending in the second direction from the bottom coaxial portion (100).

12. A log-periodic dipole antenna as defined in claim 11, wherein the top section includes a plurality of top dipole elements (210), (211), (212), (213), (214), (215), (216), (217), (218), (219) respectively collinear with but extending in directions opposite the directions of extension of bottom dipole elements (110), (111), (112), (113), (114), (115), (116), (117), (118), (119).

13. A log-periodic dipole antenna as defined in claim 12, wherein the axial separation between coaxial portion (100) and coaxial portion (200) varies from a distance d, at an end is nearest elements (110) and (210), to a distance between 2*d* and 5*d*, at an end nearest elements (119) and (219).

14. A log-periodic dipole antenna comprising two complementary sections, a top section and a bottom section, wherein the top section includes a top coaxial portion (200) along which are disposed a plurality of dipole elements (210), (211), (212), (213), (214), (215), (216), (217), (218), (219) in alternately opposite directions from the top coaxial portion (200) and wherein the bottom section includes a bottom coaxial portion (100) along which are disposed a plurality of dipole elements (110), (111), (112), (113), (114), (115), (116), (117), (118), (119) in alternately opposite directions from the bottom coaxial portion (100), wherein the axial separation between coaxial portion 100 and coaxial portion 200 varies from a distance d, at an end which is nearest elements (110) and elements (119) and (219), in a direction substantially perpendicular to the top and bottom sections.

15. A log-periodic antenna as defined in claim 14, wherein elements (110) and (210), (111) and (211), (112) and (212), (113 and (213), (114) and (214), (115) and (215), (116) and (216), (117) and (217), (118) and (218), and (119) and (219) are pairwise mutually collinear but extend in pairwise mutually opposite directions from respective coaxial portions (100) and (200).

* * * * *